US008771006B1

(12) United States Patent
Blinson

(10) Patent No.: US 8,771,006 B1
(45) Date of Patent: Jul. 8, 2014

(54) PLUG REMOVAL TOOL AND METHOD

(76) Inventor: Sidney A. Blinson, Mesa, AZ (US)

( * ) Notice: Subject to any disclaimer, the term of this patent is extended or adjusted under 35 U.S.C. 154(b) by 38 days.

(21) Appl. No.: 13/570,183

(22) Filed: Aug. 8, 2012

Related U.S. Application Data

(60) Provisional application No. 61/632,669, filed on Jan. 30, 2012.

(51) Int. Cl.
*H01R 13/00* (2006.01)

(52) U.S. Cl.
USPC ..... 439/484

(58) Field of Classification Search
USPC ..... 439/484, 477, 483, 476.1, 265
See application file for complete search history.

(56) References Cited

U.S. PATENT DOCUMENTS

| | | | | | |
|---|---|---|---|---|---|
| 1,618,723 | A | | 2/1927 | Pearson | |
| 1,677,622 | A | * | 7/1928 | Dreuil | 439/483 |
| 1,749,623 | A | | 3/1930 | Zinman | |
| 1,765,035 | A | | 6/1930 | Stubbs | |
| 1,900,782 | A | * | 3/1933 | Way | 439/160 |
| 2,005,441 | A | * | 6/1935 | Shearer | 200/51 R |
| 2,261,615 | A | * | 11/1941 | Cornwell | 439/265 |
| 2,476,735 | A | * | 7/1949 | Johnson | 439/160 |
| 2,977,564 | A | | 3/1961 | Civitelli | |
| 3,008,115 | A | | 11/1961 | Oakes | |
| 3,160,947 | A | | 12/1964 | Sunderlin | |
| 3,431,535 | A | | 3/1969 | Munyon | |
| 3,890,025 | A | * | 6/1975 | Gray | 439/102 |
| 4,042,292 | A | * | 8/1977 | Chensky | 439/160 |
| 4,111,509 | A | * | 9/1978 | Novak | 439/102 |
| 4,210,377 | A | | 7/1980 | La Voque | |
| 4,544,216 | A | * | 10/1985 | Imhoff | 439/106 |
| 4,820,187 | A | * | 4/1989 | May | 439/359 |
| 4,850,886 | A | | 7/1989 | Berke | |
| 5,062,803 | A | | 11/1991 | Howard | |
| 5,194,013 | A | * | 3/1993 | Propp | 439/265 |
| 5,249,976 | A | * | 10/1993 | Brock | 439/102 |
| 5,480,318 | A | * | 1/1996 | Garrison | 439/346 |
| D369,074 | S | * | 4/1996 | Durand | D8/14 |
| 5,516,305 | A | * | 5/1996 | Haluska | 439/484 |
| 5,690,508 | A | * | 11/1997 | Atkinson | 439/484 |
| 5,752,850 | A | * | 5/1998 | Ziegler | 439/484 |
| D404,984 | S | * | 2/1999 | Skinner | D8/14 |
| D582,228 | S | * | 12/2008 | Ordoukhanian | D8/14 |
| 8,093,497 | B2 | * | 1/2012 | White | 174/67 |
| 2003/0194903 | A1 | | 10/2003 | Tso-Chin | |

* cited by examiner

*Primary Examiner* — Alexander Gilman
(74) *Attorney, Agent, or Firm* — Thomas W. Galvani, P.C.; Thomas W. Galvani

(57) ABSTRACT

A plug removal tool for removing a plug from a receptacle includes an elongate body with an upper end and an opposed lower end. The upper end defines a handle and extends along a first axis. The lower end defines a pivot area and extends along a second axis transverse to the first axis. A slot is formed in the lower end to receive a prong of the plug.

19 Claims, 3 Drawing Sheets

PLUG REMOVAL TOOL AND METHOD

CROSS-REFERENCE TO RELATED APPLICATION

This application claims the benefit of U.S. Provisional Application No. 61/632,669, filed Jan. 30, 2012.

FIELD OF THE INVENTION

The present invention relates generally to electronic accessories, and more particularly to methods and apparati for removing a plug from an electrical receptacle.

BACKGROUND OF THE INVENTION

A plug and socket are complemental engagement elements for connecting an electrical device to a source of electricity. The plug is a male element with projecting prongs, and the socket, or receptacle, is a complemental female element with recessed slots to receive the prongs. Safety and consistency of the electrical engagement are of significant concern in the plug-receptacle connection. The majority of plugs and receptacles in the United States and around the world conform to the standards set by the National Electrical Manufacturers Association "NEMA"). The most common types of connectors have two prongs (known as NEMA 1 connectors) or three prongs (known as NEMA 5 connectors). The description contained herein will refer to NEMA connectors for illustrative purposes, and NEMA 5 connectors especially because of the prolific standardization of the NEMA 5 connector, but it should be understood that the present invention is not limited to NEMA connectors.

Two-prong connectors constructed according to NEMA standards are two-wire non-grounding devices and have two spaced apart, parallel blades. One of the blades is a live terminal, and the other of the blades is a neutral terminal. Three-prong connectors constructed according to NEMA standards are three-wire grounding devices and have two spaced-apart, parallel blades and a grounding pin. One of the blades is a live terminal, the other of the blades is a neutral terminal, and the grounding pin establishes a grounding connection with the earth for safety. The grounding pin is longer than the blades so that the electrical device is grounded before the electrical connection is made between the plug and the receptacle.

Generally, to remove a plug from a receptacle, a user grabs the plug or cord extending from the plug and pulls, while simultaneously bracing or pressing against the receptacle. Six to eight pounds of force are required to remove a plug from a socket because the tips of the prongs, when installed into the slots in the receptacle, are press fit into the slots. Applying sufficient force generally requires placing one hand near the receptacle. This can be dangerous and difficult for a variety of reasons. For instance, if the receptacle is one of several receptacles along a power strip or surge protector, and the power strip or surge protector is not fixed in place, the user must grasp the power strip to prevent the power strip from moving when the plug is pulled. Moreover, a power strip may have little available room for grasping, especially if all of the receptacles are occupied with plugs. Grasping near the switch of the power strip may turn off power to all of the receptacles on the power strip, thereby inadvertently shutting off all electrical devices when the user only intended to decouple a single device. In other instances, the receptacle may be in a recessed location, such as under a desk, behind a bed, or otherwise difficult to reach. It can be very cumbersome to reach with two hands into small, recessed locations to pull a plug. Often times, using two hands prevents the user from being able to position his head into the space to see where his hands are moving. In such situations, the user may pull the wrong plug, may grab a partially-installed plug and electrocute himself, or may not be able to pull with the requisite six to eight pounds of force needed to remove the plug from the receptacle. In yet other instances, individuals with only a single hand or single arm have great difficulty removing plugs from receptacles. Such users may not be able to remove plugs in recessed locations at all, and may have to use their feet to brace a receptacle when pulling a socket that is not recessed and hidden away. An improved method and device for removing a plug from a receptacle is needed.

SUMMARY OF THE INVENTION

According to the principle of the invention, a plug removal tool for removing a plug from a receptacle includes an elongate body having an upper end and an opposed lower end. The upper end defines a handle and extends along a first axis. The lower end defines a pivot area and extends along a second axis transverse to the first axis. A slot formed in the lower end is sized to closely receive a prong of the plug. The plug removal tool moves between a first position and a second position with respect to a plug applied in a receptacle. In the first position of the plug removal tool, the plug is seated on the receptacle, and in the second position of the plug removal tool, the plug is unseated on the receptacle. A user removes the plug from the receptacle by gripping the plug removal tool together with the plug and moving the plug removal tool and the plug together to pivot the plug removal tool so as to unseat the plug from the receptacle.

BRIEF DESCRIPTION OF THE DRAWINGS

Referring to the drawings.

DETAILED DESCRIPTION

Figure 1:
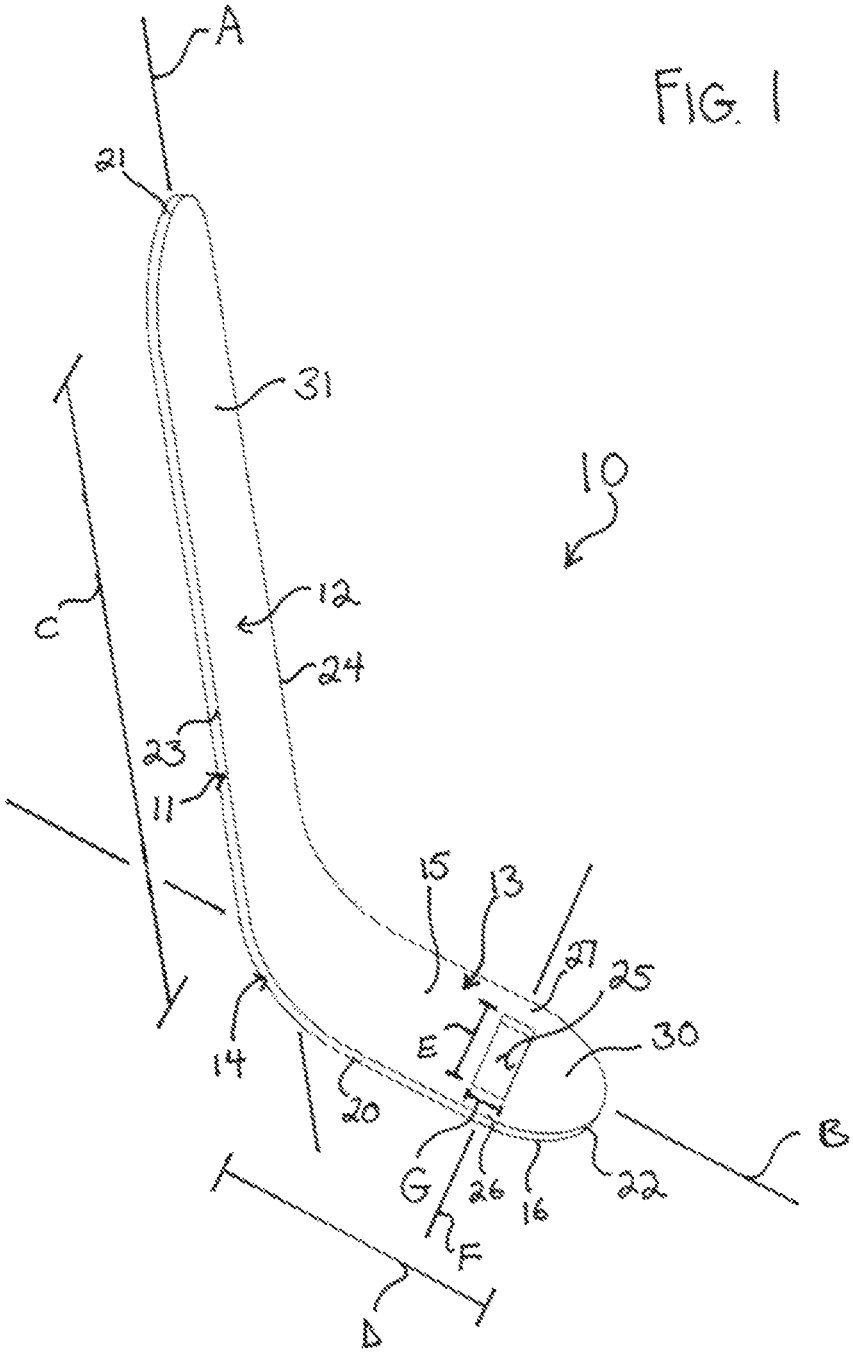
FIG. 1 is a perspective view of a plug removal tool constructed and arranged according to the principle of the invention.

Reference now is made to the drawings, in which the same reference numbers are used throughout the different figures to designate the same components. FIG. 1 illustrates a plug removal tool 10 constructed and arranged in accordance with the principle of the invention. The plug removal tool 10 is a lever useful for removing a plug from a receptacle and includes an elongate body 11 having an upper end 12, an opposed lower end 13, and an elbow 14 located between the upper and lower ends 12 and 13 at which the body 11 is bent. The upper end 12 defines a handle of the plug removal tool 10, and the lower end 13 defines a pivot area of the plug removal tool 10.

The plug removal tool is thin and has an upper face 15, an opposed lower face 16, and a peripheral edge 20 extending continuously around the plug removal tool 10. The upper and lower faces 15 and 16 are flat and parallel to each other along a length of the plug removal tool 10. The peripheral edge 20 is semicircular about a rear edge 21 of the upper end 12, is semicircular about a front edge 22, or pivot, of the lower end 13, and is straight between the front and rear edges 12 and 22, defining two opposed, parallel side edges 23 and 24.

A first axis A extends along the upper end 12 between the rear edge 21 and the elbow 14. The upper end 12 is bilaterally symmetric with respect to the first axis A. A second axis B extends along the lower end 13 between the front edge 22 and the elbow 14. The lower end 13 is bilaterally symmetric with respect to the second axis B. The first and second axes A and B intersect with each other and are transverse with respect to each other because the upper and lower ends 12 and 13 are oriented at approximately 120 degrees with respect to each other.

The upper end 12 of the plug removal tool 10 has a length C between the rear edge 21 and the elbow 14, and the lower end 13 has a length D between the front edge 22 and the elbow 14. Length C is approximately two and a half times length D. In a preferred embodiment, length C is approximately 2.47 inches and length D is approximately 0.96 inches. The upper end 12 provides a pivotal mechanical advantage about the lower end 13.

With reference still to FIG. 1, an elongate slot 25 is formed through the lower end 13 of the plug removal tool 10 from the upper surface 15 through to the lower surface 16, which is a distance of approximately 0.03 inches. The slot is a four-sided opening and has a width E extending between the side edges 23 and 24 along an axis F and a thickness G extending transverse to width E. Width E is preferably approximately 0.325 inches and thickness G is preferably approximately 0.10 inches. Width E along axis F is transverse with respect to axes A and B, so that the slot 25 is aligned transverse with respect to axes A and B. The slot 25 defines a prong-receiving slot.

The slot 25 is formed through the plug removal tool 10 between the front edge 22 and the elbow 14 at a location approximately one-third of the length D inboard from the front edge 22, such that the slot 25 defines a projecting semicircular tab or tip 30 between the slot 25 and the front edge 22. The tip 30 is a rigid projection of the lower end 13 and is co-planar with the lower end 13. The slot 25 extends substantially between the opposed side edges 23 and 24, defining opposed ribs 26 and 27 extending between the lower end 13 and the tip 30, such that the slot 25 is completely encircled by the elongate body 11 of the plug removal tool 10.

The plug removal tool 10 is constructed of a material or combination of materials having flexible, resilient, shape-memory, and durable material characteristics, such as metal or plastic. The plug removal tool is constructed from a material having a low modulus of elasticity so that more than sixteen to eighteen pounds of force applied to the plug removal tool 10 will cause the plug removal tool 10 to bend and yield elastically before damaging the receptacle. A dielectric coating, such as parylene or an elastomeric coating, is applied to the plug removal tool 10 to electrically insulate the plug removal tool 10. The dielectric coating has a dielectric insulation factor of 2500 volts. Additionally, a rubber casing 31 is applied to the plug removal tool 10 to further electrically insulate the plug removal tool 10. In the embodiment shown in FIG. 1, the rubber casing 31 extends over the entire lever from the rear edge 21 to the front edge 22 and from side edge 23 to side edge 24. In other embodiments, such as those shown in FIGS. 2-5, the rubber casing 31 extends over the upper end 12 of the plug removal tool 10 to electrically insulate the handle. The rubber casing 31 is preferably heat-shrink tubing, such as constructed from polyolefin or nylon, which constricts around a structure when heat is applied to the tubing. The plug removal tool 10 is colored for identification with one or many colors. The color is carried by one of the body 11 of the plug removal tool 10, the dielectric coating, or preferably the rubber casing 31.

Figure 2:
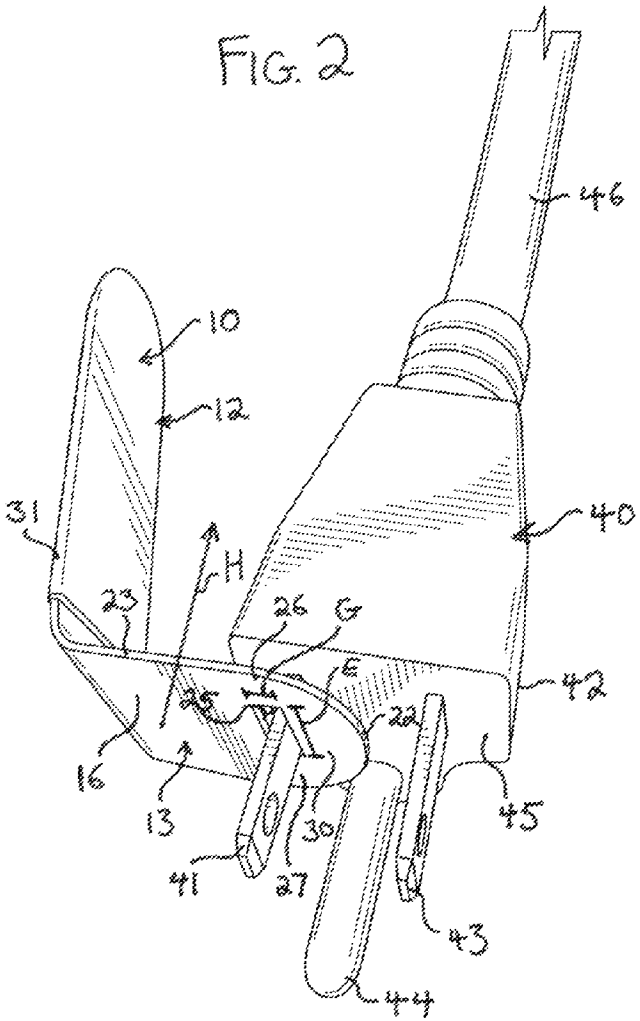
FIG. 2 is a perspective view of the plug removal tool of FIG. 1 as it would appear applied to a prong of a plug.

Turning now to FIGS. 2-5, various steps in the operation of the plug removal tool 10 are illustrated. The plug removal tool 10 is useful for removing a plug from a receptacle. FIG. 2 illustrates the plug removal tool 10 applied to a prong 41 of a plug 40. The plug 40 is exemplary of a standard NEMA 5 connector and has a plug body 42, a second prong 43 and a grounding pin 44 extending outward from a face 45. A cord 46, which houses wires coupled to the prongs 41 and 43, extends upwardly away from the body 42 of the plug 40 to an electrical device (not shown). The prongs 41 and 43 are each approximately 0.25 inches wide, approximately 0.06 inches thick, and between approximately 0.625 and approximately 0.71875 inches long, and are approximately 0.5 inches apart from each other. The grounding pin 44 is approximately 0.1875 inches in diameter, 0.625 inches long, and is offset from the prongs 41 and 43 by 0.25 inches.

The plug removal tool 10 is moved into the installed condition shown in FIG. 2 by first taking up the plug removal tool 10, as by hand at the handle, while the plug removal tool 10 is in a free condition away from the plug 40 and directing the lower end 13 of the plug removal tool 10 downward. The cord 45 or the plug 40 is then taken up by another hand, and the lower end 13 is moved toward the plug 40. The user registers the slot 25 with one of the prongs 41 and 43, aligning the body 11 of the plug removal tool 10 normal to the widths of the prongs 41 and 43, so that axes A and B extend transverse with respect to the widths of the prongs 41 and 43. For purposes of this discussion, reference will be made to prong 41, though it should be understood that the plug removal tool 10 can be usefully applied to either the prong 41 or the plug 43. It should also be understood that the plug removal tool 10 is useful for its intended purpose when applied to a single prong 41 of the plug 40. The slot is sized to allow limited movement of the tool after receipt of prong 41. The user aligns the axis F of slot 25 with the width of the prong 41 and then moves the plug removal tool 10 onto the prong 41 and the plug 40 in a direction generally indicated by arrowed line H in FIG. 2. The plug removal tool 10 is moved fully onto the plug 40, with the slot 25 slidingly received over the prong 41, until the upper face 15 of the plug removal tool 10 at the lower end 13 encounters the face 45 of the plug 40, defining an installed condition of the plug removal tool 10 with respect to the plug 40. In this installed condition, the slot 25 closely receives the prong 41 of the plug 40 and allows a small amount of play of the prong 41 in the slot 25. There are approximately 0.04 inches in play between the width E of the slot 25 and the width of the prong 41 and approximately 0.1 inches in play between the thickness G of the slot 25 and the thickness of the prong 41. The upper face 15 of the plug removal tool 10 at the lower end 13 and the tip 30 is in continuous contact with the face 45 of the plug 40, flat against the face 45.

Figure 3:
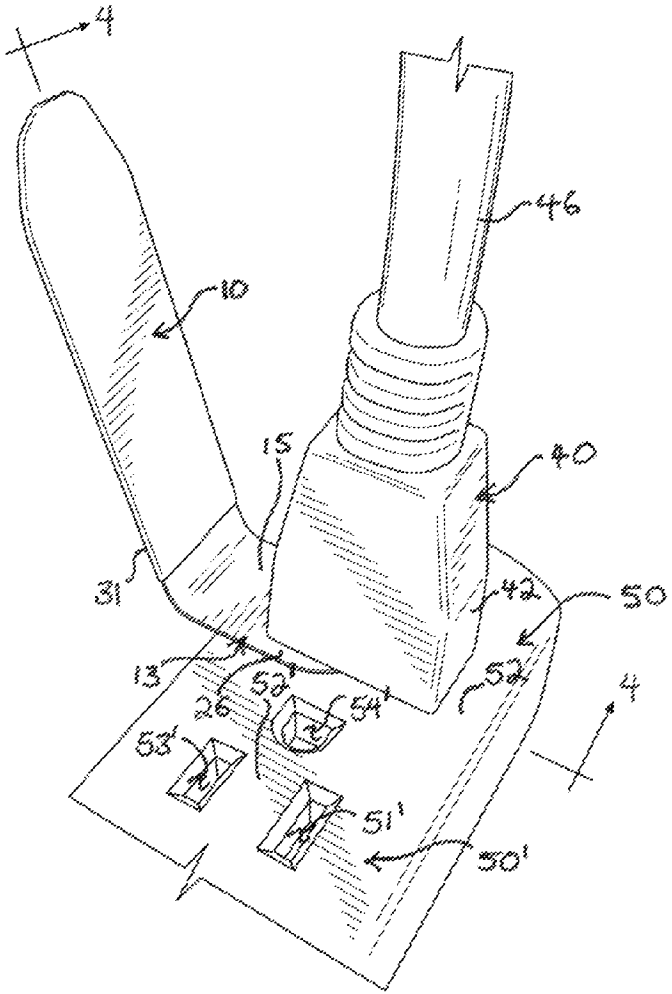
FIG. 3 is a perspective view of the plug removal tool of FIG. 1 applied to a prong of a plug in a seated condition of the plug with respect to a receptacle.

The plug removal tool 10 and the plug 40 are then moved together from a free position, shown in FIG. 2, to an installed position with respect to a receptacle 50, as shown in FIG. 3. The receptacle 50 is exemplary of a NEMA 5 receptacle on a power strip in which there are several receptacles 50 in series. Because the plug removal tool 10 extends to the side of the plug 40 with the axes A and B transverse to the width of the prong 40, several plug removal tools 10 can be applied to plugs 40 for installation into each of the series receptacles 50 in the power strip to allow for operation of each plug removal tool 10 at respective receptacles without interfering with the operation of neighboring plug removal tools 10. FIG. 3 illustrates receptacle 50 and receptacle 50', which are identical in structure and function. As such, reference characters used to describe the various structural features of the receptacle 50 are applied to the receptacle 50' for reference purposes, and carry the prime ("") marking to designate those structural features as part of receptacle 50'. The receptacle 50 has a first slot 51, a face 52, a second slot 53, and a grounding slot 54. The plug 40 is applied to the receptacle 50, with the plug removal tool 10 carried on the prong 41 of the plug 40, by aligning the prongs 41 and 43 of the plug 40 with the slots 51 and 53 of the receptacle 50 and pressing the plug 40 downward toward the receptacle 50, seating the plug 40 in the receptacle 50 in electrical engagement, with the prong 41 received in the slot 51, the prong 43 received in the slot 53, the grounding pin 44 received in the grounding slot 54, and the lower end 13 of the plug removal tool 10 located between the face 52 of the receptacle 50 and the face 45 of the plug 40, which arrangement defines a seated condition of the plug 40 with respect to the receptacle 50, and an installed condition and first position of the plug removal tool 10 with respect to the plug 40.

Figure 4:
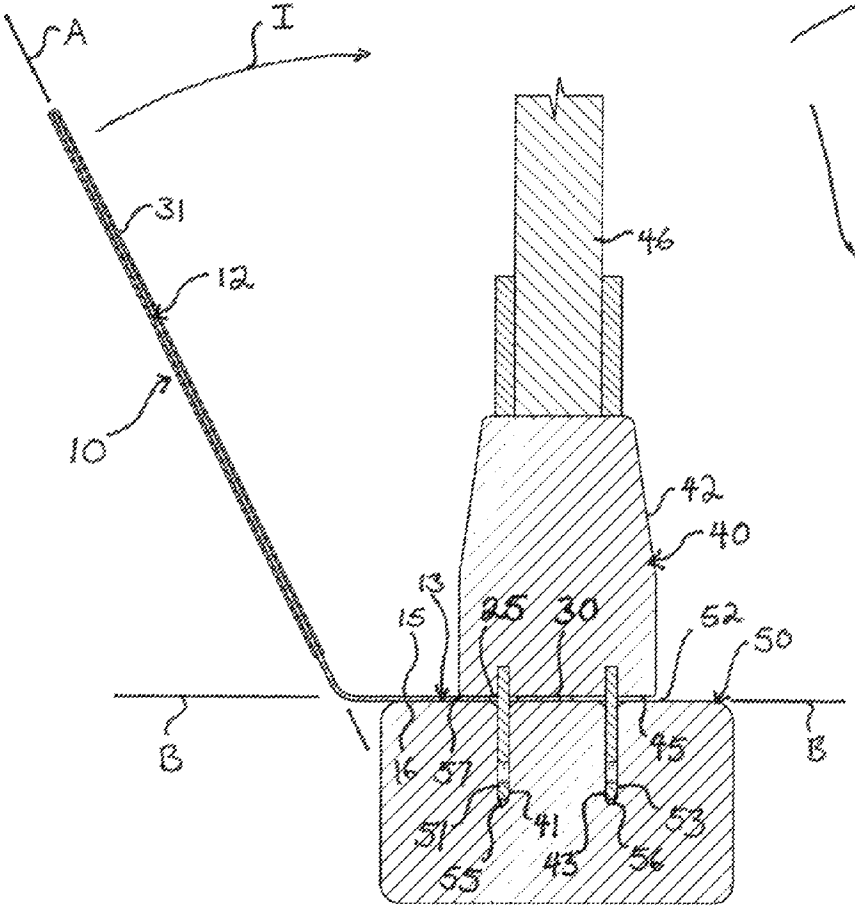

FIG. 4 is a section view illustrating the installed condition and first position of the plug removal tool 10 and the seated condition of the plug 40 in the receptacle. In this arrangement, the plug 40 is coupled in electrical communication to the receptacle 50 for transmission of electricity from electrical contacts 55 and 56 at the bottom of each of the slots 51 and 53, respectively, to the plug 40 and the electrical device. The axis B and the lower end 13 of the plug removal tool 10 are parallel to and just above the face 52 of the receptacle 50. The lower face 16 of the plug removal tool 10 at the lower end 13 is in contact with the face 52 of the receptacle 50, and the upper face 15 of the plug removal tool 10 at the lower end 13 is in contact with the face 45 of the plug 40. The plug 40 is closely spaced apart from the receptacle 50 by the lower end 13 of the plug removal tool, such that the face 45 of the plug 40 is spaced approximately 0.03 inches from the face 52 of the receptacle 50. The tip 30 projects between the faces 45 and 52 of the plug 40 and receptacle 50, respectively, to approximately halfway between the prongs 41 and 43. The upper end 12 of the plug removal tool 10 is to the side of the plug 40 and extends diagonally upwardly from a peripheral edge 57 of the receptacle 50, so that axis A is oriented at an angle with respect to the receptacle 50 and at an acute angle with respect to the cord 46. The plug removal tool 10 is left installed on the plug 40 while the plug is applied to the receptacle 50 and during operation of the electrical device. The dielectric coating and the rubber casing 31 prevent electrical shock during operation.

During operation, the color of the plug removal tool 10 serves to identify and distinguish the plug 40 of the electrical device from the plugs 40 of other electrical devices, which may carry other colored plug removal tools 10. A user can thus apply plug removal tools 10 of one color to plugs 40 of a group of similar electrical devices and apply plug removal tools 10 of another color to plugs 40 of another group of similar electrical devices, in order to organize and distinguish the plugs 40 of the electrical devices from each other. A music ensemble, for instance, may use plug removal tools 10 of one color on plugs of the equipment of a drummer, plug removal tools 10 of another color on plugs of the equipment of a bass guitarist, plug removal tools 10 of yet another color on plugs of the equipment of the rhythm guitarist, and plug removal tools 10 of yet still another color on plugs for the loudspeakers. In this way, one group of plugs 40 can be decoupled from receptacles 50 without accidentally decoupling other plugs 40.

Figure 5:
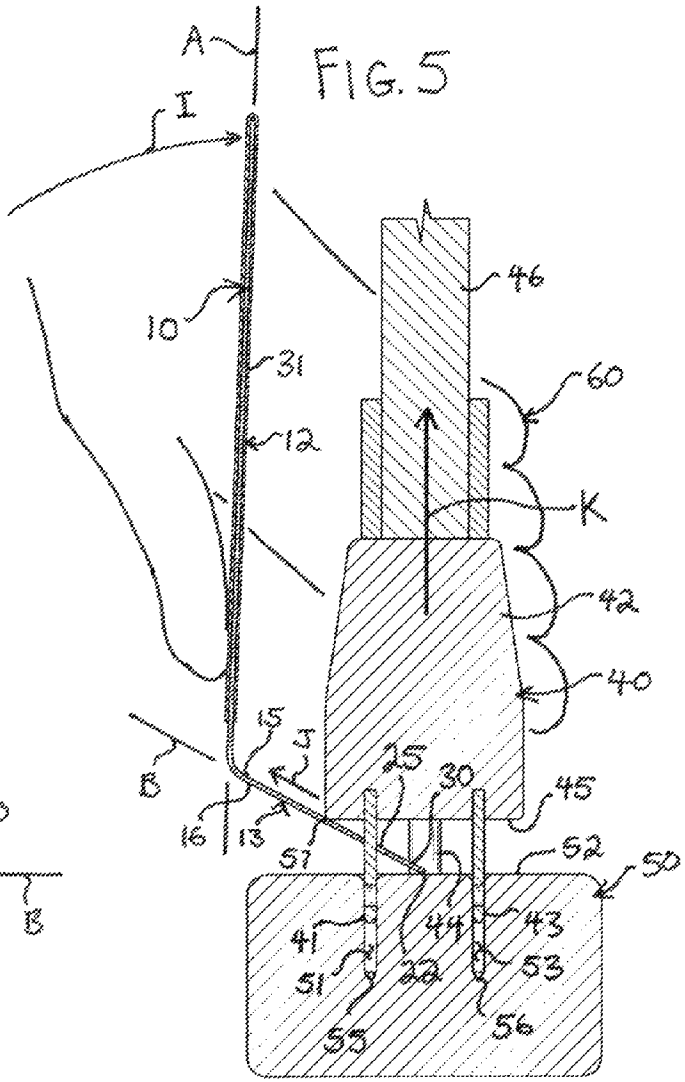
FIGS. 4 and 5 are section views of the plug removal tool of FIG. 1 taken along the line 4-4 in FIG. 3, illustrating the removal of the plug from the receptacle.

When a user desires to remove the plug 40 from the receptacle 50, the user need only take up the plug removal tool 10, as by hand, and squeeze and extract the plug 40 in a single, fluid, continuous motion while maintaining a grip on the plug removal tool 10. FIG. 5 shows the removal of the plug 40 from the receptacle 50. While the plug removal tool 10 is the first position shown in FIG. 4, a user 60 grips the plug removal tool 10 and the cord 46 together, preferably on the cord 46 proximate to the plug 40. Alternatively, the user may grip the plug removal tool 10 and the plug 40 together, or may grip the plug removal tool 10, the plug 40, and the cord 46. Though at least these three gripping arrangements exist, this discussion will refer to a gripping arrangement including the plug removal tool 10 and the cord 46 gripped together with the understanding that the removal procedure is the same with grammatical substitution of the plug 40, or the plug 40 and the cord 46, for the cord 46. In a preferred gripping arrangement, the user 60 applies his palm or thumb against the plug removal tool 10, with the thumb directed toward the receptacle 50, and wraps his fingers around the cord 46 to grip the plug removal tool 10 together with the cord 46, as shown in FIG. 5. While maintaining the gripping arrangement, the user 60 next closes his hand, moving the plug removal tool 10 and the cord 46 together in a direction generally indicated by arrowed line I from the first position to a second position proximate to the plug 40 and the cord 46. Preferably, when the user 60 closes his hand, the user 60 moves the plug removal tool 10 and holds his hand steady so as to hold and maintain the cord 46 and the plug 40 stationary with respect to the receptacle 50, to avoid bending the prongs 41 and 43 and the grounding pin 44 within the slots of the receptacle 50. NEMA 5 receptacles will crush if a force of more than sixteen pounds is applied to the receptacle. To prevent damage to the receptacle 50, the plug removal tool 10 yields in response to application of more than sixteen pounds of force applied along the upper end 12. The flexible, shape-memory, and durable material characteristics of the plug removal tool 10 allows the plug removal tool 10 to elastically return to its original shape upon removal of the application of force.

In response to the user 60 moving the plug removal tool 10 and the cord 46 together, the plug removal tool 10 pivots with respect to the plug 40 so as to unseat the plug 40 from the receptacle 50. As the plug removal 10 pivots, the lower end 13 rises with the slot 25 rising along the prong 41, and the lower face 16 pivots away from the face 52 of the receptacle 50. The movement of the slot 25 rising along the prong 41 guides the movement of the plug removal tool 10 from the first position to the second position proximate to the cord 46 in a single plane of movement. The close fit between the slot 25 and the prong 41 ensures that the plug removal tool 10 pivots in a single direction between the first and second positions of the plug removal tool 10 with respect to the plug 40, so that the plug removal tool 10 moves in an arc within a single plane defining axes A, B, and prongs 41, and 43, so that the plug removal tool 10 does not deviate from the plane and touch another electrical component. Pivoting the plug removal tool 10 about the lower end transfers the force applied at the upper end 12 through the mechanical advantage of the upper end 12 to the tip 30 on the lower end 13 into the receptacle 50, so that as the slot 25 rises on the prong 41, the tip 30 is pressed into the face 52 of the receptacle 50 and slides toward the prong 41 slightly. The peripheral edge 57 of the plug 40 slides in continuous contact with the upper face 15 of the lower end 13 of the plug removal tool 10 toward the elbow 14 as generally indicated by the arrowed line J in FIG. 5. The peripheral edge 57 is in direct contact with the upper face 15 throughout movement of the plug removal tool 10 between the first and second positions, and the face 52 of the receptacle 50 is in direct contact with the front edge 22 of the body 11 throughout movement of the plug removal tool 10 between the first and second positions, such that the front edge 22 of the body 11 defines a pivot, and such that the body 11 maintains contact with and exerts direct force on both the plug 40 and the receptacle 50 about the pivot at the front edge 22 during movement of the plug removal tool 10.

The contact between the edge 57 and the rising upper face 15 causes the plug 40 to retract from the receptacle 40 along a direction generally indicated by arrowed line K. The user continues to move the plug removal tool 10 toward the cord 46 until the prongs 41 and 43 are decoupled from the contacts 55 and 56 in the slots 51 and 53, respectively, and the plug 40 is in an unseated condition with respect to the receptacle 50. In the unseated condition of the plug 40, the face 45 of the plug 40 is spaced apart from the face 52 of the receptacle 50, and the plug 40 is not engaged in electrical communication with receptacle 50. The plug 40 is now available to be easily retracted from the receptacle 50 by continuing to grip the plug removal tool 10 and the cord 46 together in the gripping arrangement and pulling along the direction indicated by arrowed line J.

Although the removal of the plug 40 from the receptacle 50 using the plug removal tool 10 is described above as a series of sequential steps, it should be understood that the removal of the plug 40 is preferably accomplished in a single, fluid, continuous motion requiring less than one second. The present invention is described above with reference to a preferred embodiment. However, those skilled in the art will recognize that changes and modifications may be made in the described embodiment without departing from the nature and scope of the present invention. Various further changes and modifications to the embodiment herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

1. A plug removal tool for removing a plug from a receptacle, the plug having a peripheral edge, the plug removal tool comprising:

an elongate body having an upper end and an opposed lower end having an upper face and a front edge;

the upper end defines a handle and extends along a first axis;

the lower end defines a pivot area and extends along a second axis transverse to the first axis;

a slot is formed in the lower end to receive a prong of the plug; the slot is sized to receive the prong of the plug;

the elongate body moves between a first position in which the plug is seated in the receptacle and a second position in which the plug is unseated from the receptacle; and during movement of the elongate body between the first and second positions, the front edge of the lower end defines a pivot for the elongate body with respect to the receptacle, and the peripheral edge of the plug slides in continuous contact against the upper face of the lower end.

2. The plug removal tool of claim 1, wherein the slot is transverse with respect to the first and second axes.

3. The plug removal tool of claim 1, wherein the elongate body elastically yields in response to an application of force of sixteen pounds to prevent damage to the receptacle.

4. The plug removal tool of claim 1, wherein the elongate body is electrically insulated.

5. The plug removal tool of claim 1, wherein a dielectric coating is applied to the elongate body.

6. The plug removal tool of claim 1, wherein:

the upper end of the elongate body has a length;

the lower end of the elongate body has a length;

the length of the upper end is approximately 2.5 times longer than the length of the lower end; and the slot is formed approximately one-third of the length of the lower end away from the front edge of the lower end.

7. The plug removal tool of claim 1, wherein the lower end of the elongate body has a semicircular tip terminating in the front edge, which semicircular tip avoids contact with a grounding prong of the plug during movement of the elongate body between the first and second positions thereof.

8. A plug removal tool for removing a plug from a receptacle, the plug having a peripheral edge, the plug removal tool comprising:

a lever for installation on a single prong of the plug for movement between a first position and a second position with respect to the receptacle, the lever having an upper end and an opposed front edge; the lever having an upper face;

in the first position of the lever, the plug is seated in the receptacle;

in the second position of the lever, the plug is unseated from the receptacle; and the front edge of the lever defines a pivot for movement of the lever between the first and second positions, during which movement the peripheral edge of the plug slides in continuous contact against the upper face of the lever.

9. The plug removal tool of claim 8, wherein in the first position of the lever, the upper end of the lever is away from the plug.

10. The plug removal tool of claim 9, wherein in the second position of the lever, the upper end of the lever is proximate to the plug.

11. The plug removal tool of claim 8, wherein the lever is constructed from a single, resilient piece of material.

12. The plug removal tool of claim 8, wherein the lever is electrically insulated.

13. The plug removal tool of claim 12, wherein a dielectric coating is applied to the lever.

14. The plug removal tool of claim 12, wherein a rubber casing is applied to the lever.

15. The plug removal tool of claim 14, wherein the rubber casing extends over the entire lever.

16. The plug removal tool of claim 14, wherein the rubber casing extends over the upper end of the lever alone.

17. A method of removing a plug from a receptacle, the plug including a body, a prong extending from the body into the receptacle, and a cord leading to the body, the method comprising the steps of:

providing a plug removal tool on the plug, wherein the plug removal tool includes an elongate body having an upper end, an opposed lower end, an upper face on the lower end, a front edge on the lower end, and a slot formed through the lower end receiving the prong of the plug, which plug is seated in the receptacle for electrical communication between the plug and the receptacle;

gripping the plug removal tool together with the plug;

moving the plug removal tool and the plug together by pivoting the plug removal tool at the front edge against the receptacle and sliding the peripheral edge of the plug along the upper face of the lower end of the plug removal tool to pivot the plug removal tool with respect to the plug so as to unseat the plug from the receptacle; and retracting and removing the plug removal tool and the plug together from the receptacle;

wherein the steps of gripping, moving, and retracting and removing are each performed while maintaining a continuous gripping arrangement on the plug removal tool and the plug.

18. The method of claim 17, wherein the step of moving the plug removal tool and the plug together comprises moving the plug removal tool toward the plug while holding the plug stationary with respect to the receptacle.

19. The method of claim 17, wherein the step of gripping the plug removal tool together with the plug further comprises gripping the plug removal tool with a preferred gripping arrangement, the preferred gripping arrangement comprising:

a palm of a hand applied against the plug removal tool;

a thumb of the hand directed toward the receptacle; and fingers of the hand wrapped around the cord of the plug.

* * * * *